US007537062B2

(12) United States Patent
Hughes et al.

(10) Patent No.: US 7,537,062 B2
(45) Date of Patent: May 26, 2009

(54) FLAPPER VALVE AND ACTUATOR

(75) Inventors: William James Hughes, Bixby, OK (US); Richard W. Adams, Houston, TX (US)

(73) Assignee: Sunstone Corporation, Oklahoma City, OK (US)

( * ) Notice: Subject to any disclaimer, the term of this patent is extended or adjusted under 35 U.S.C. 154(b) by 289 days.

(21) Appl. No.: 11/464,389

(22) Filed: Aug. 14, 2006

(65) Prior Publication Data

US 2008/0035353 A1 Feb. 14, 2008

(51) Int. Cl.
*E21B 34/06* (2006.01)

(52) U.S. Cl. ..... 166/386; 166/332.8; 251/298

(58) Field of Classification Search ..... 166/316, 166/332.8, 386; 251/228, 298, 339
See application file for complete search history.

(56) References Cited

U.S. PATENT DOCUMENTS

| | | | | | |
|---|---|---|---|---|---|
| 2,162,578 | A | * | 6/1939 | Hacker | 175/248 |
| 2,849,207 | A | * | 8/1958 | Conrad | 251/349 |
| 3,289,691 | A | | 12/1966 | Kennard | |
| 3,470,903 | A | * | 10/1969 | Scott | 137/467 |
| 3,687,157 | A | | 8/1972 | Whitmer | |
| 3,974,848 | A | | 8/1976 | Wheatley | |
| 4,161,985 | A | * | 7/1979 | Fournier et al. | 166/321 |
| 4,407,325 | A | | 10/1983 | Cherniak | |
| 4,478,244 | A | | 10/1984 | Garrett | |
| 4,586,534 | A | | 5/1986 | McNeely | |
| 4,650,153 | A | | 3/1987 | Winegeart | |
| 4,727,939 | A | | 3/1988 | Airey | |
| 4,825,902 | A | | 5/1989 | Helms | |
| 5,044,396 | A | | 9/1991 | Daudet et al. | |
| 5,099,877 | A | | 3/1992 | Fluegel | |
| 5,310,005 | A | | 5/1994 | Dollison | |
| 5,388,622 | A | | 2/1995 | Phillips | |
| 5,682,921 | A | | 11/1997 | Rawson et al. | |
| 5,819,853 | A | * | 10/1998 | Patel | 166/373 |
| 6,119,723 | A | | 9/2000 | Kenyon | |
| 6,328,109 | B1 | | 12/2001 | Pringle et al. | |
| 6,848,509 | B2 | | 2/2005 | Myerley | |
| 2002/0079104 | A1 | | 6/2002 | Garcia et al. | |
| 2003/0178199 | A1 | | 9/2003 | Deaton | |

OTHER PUBLICATIONS

"Underbalanced Drilling Deployment Valve Introduction & Development Overview," Techcorp Industries Inc. and Alpine Oil Services, Inc.

* cited by examiner

*Primary Examiner*—Kenneth Thompson
(74) *Attorney, Agent, or Firm*—Yee & Associates, P.C.; Rudolf O. Siegesmund; Grant Rodolph

(57) ABSTRACT

An improved flapper valve is disclosed comprising a housing, a flapper pivotally engaged to the housing, and an actuator slidingly engaged in the housing and adapted to make initial contact with the flapper at a seat end. The seat end is an area surrounding a point on a flapper bottom surface that is furthest from the location of pivotal engagement of the flapper and the housing but not in contact with the housing. The flapper closes at an acute angle to the longitudinal axis of the housing. The actuator is hollow and the interior of the actuator forms a through bore. In the closed position the flapper prevents fluid from the passing through the bore.

18 Claims, 14 Drawing Sheets

15

FLAPPER VALVE AND ACTUATOR

FIELD OF THE INVENTION

This invention is generally related to flapper valves used in drilling operations, and specifically to a flapper valve comprising a flapper and an actuator adapted for reducing a requirement to have equal pressure across the flapper valve before opening.

BACKGROUND OF THE INVENTION

Currently, strong demand for energy and uncertain supplies have created interest in tapping unconventional reservoirs. Reservoirs with low permeability are difficult to recover using conventional drilling techniques because conventional techniques significantly reduce permeability. In the absence of permeability, oil and gas deposits cannot be recovered. Horizontal drilling greatly facilitates recovery of hydrocarbons, but traditional horizontal drilling techniques decrease permeability. The combination of underbalanced drilling and horizontal drilling makes it possible to maximize the productivity of a low permeability reservoir by not decreasing its permeability during the drilling process.

The interest in recovering deposits from more difficult reservoirs has increased the need for better underbalanced drilling techniques. Some underbalanced drilling situations require the ability to seal off the downstream portion of the tubing using a flapper valve at various stages of the drilling process. These underbalanced drilling situations also require the capability to pass a drill bit through the flapper valve when the flapper valve is open. In addition, these underbalanced drilling situations require a way to open the flapper valve against some downstream pressure resisting its opening without damage to the flapper valve.

Prior art devices for control of fluid flow in a tubing, known as check valves, are adaptable for underbalanced drilling application. One type of check valve, commonly referred to as a "flapper" check valve (hereafter "flapper valve"), contains a valve element hinged to pivot in the desired direction of flow. Some flapper valves use two semi-circular gate elements that pivot from a support in the center of the valve. Because a two gate flapper valve cannot allow a drill bit to pass through the tubing, only single gate flapper valves are suitable for under-balanced drilling situations. Moreover, in order to facilitate the flow of fluids and the passage of a drill bit, these single gate flapper valves must have gates that conform to the shape of the tubing when in the open position. Therefore, as used herein, the term flapper valve shall mean a valve with a single gate that conforms to the shape of the tubing when in the open position.

Single gate flapper valves can close perpendicularly to the tubing, or they can close at an acute angle to the high pressure side. U.S. Pat. No. 4,407,325 (the '325 patent) and U.S. Pat. No. 6,328,109 (the '109 patent) disclose flapper valves that close at an approximate ninety degree angle to the tubing wall. The '325 patent and the '109 patent flapper valves achieve conformity to the shape of the tubing by pivoting into a recess in the tubing or tubing assembly in the open position so that passage through the tubing in unimpeded when the valve is in an open position.

U.S. Pat. No. 5,044,396 (the '396 patent) and U.S. Pat. No. 5,099,877 (the '877 patent) disclose flapper valves that conform to the shape of the tubing when open, and that form an acute angle to the high pressure side. Conformity to the shape of the tubing in the open position minimizes pressure drop and energy loss. Additionally, the flapper valves of the '396 patent and the '877 anchor against the opposite side of the tubing from the valve hinge, and when closed the valves form an obtuse angle on the low pressure side and an acute angle on the high pressure side. The acute angle provides increased strength to the valve. Once closed, the valves of the '396 patent and the '877 patent can be opened by exertion of a greater pressure on the acute angle side than on the obtuse angle side.

U.S. Pat. No. 6,848,509, "Pressure Equalizing Plunger Valve for Downhole Use," discloses a "thru-the-flapper" self equalizing system, (the '509 patent). In the '509 patent, a sleeve, which can be a concentric casing, slides down to open a flapper valve. The sleeve depresses a plunger in the valve to open an equalizing path prior to the valve opening and the '509 patent addresses improvements to reduce wear on the equalizing plunger.

In "Underbalanced Drilling Deployment Valve Introduction & Development Overview," Techcorp Industries Inc. and Alpine Oil Services, Inc. (hereafter Techcorp) disclose a flapper valve with a sliding lower actuator extension mounted for sliding movement within the housing that opens the valve once the valve is equalized by the pumping of fluids through the valve in the closed position. The flapper is sealed within a flapper cage flush with the housing when the deployment valve is open. A flapper spring maintains the flapper in its closed position creating a seal between the flapper and the flapper seat. The deployment valve provides a through bore to allow passage of a drill bit. But when the flapper is subjected to downstream pressure, pressures must be equalized before the flapper can be opened. The lower actuator extension contacts the flapper at two points in the middle of the flapper, creating significant opening force on the valve hinge. Furthermore, the flapper closes at 90° with respect to the longitudinal axis of the housing, making it more difficult open. The Techcorp device is discussed in greater detail in FIG. 1 and FIG. 2 below.

FIG. 1 depicts prior art deployment valve 100 in its closed position. Deployment valve 100 is rendered hollow by through bore 110 through housing 124. Lower actuator extension 114, which is hollow, is slidably inserted into one end of deployment valve 100, and tubing 118 is threadedly attached by its male threads 120 to female threads 122 in the opposing end of deployment valve 100. Valve seat 108 encircles lower actuator extension 114 and has essentially the same inner diameter as the outer diameter of lower actuator extension 114. In its closed position, flapper 102 is urged by flapper spring 106 against valve seat 108 to prevent fluid within through bore 110 below flapper 102 from entering through bore 110 above flapper 102. Flapper pin 104 mounts flapper 102 within deployment valve 100. Flapper cage 112, in the form of a recess in housing 124, receives flapper 102 when deployment valve 100 is fully opened so that flapper 102 is flush within housing 124. Tubing 118 is a portion of a plurality of vertical tubing sections that have been connected together to make a semi-rigid drill string.

FIG. 2 depicts prior art deployment valve 100 in its open position. To open deployment valve 100, lower actuator extension 114 strikes flapper 102 at two contact points 116 (only one of which is visible) once pressures are equalized on either side of flapper 102. Because contact points 116 are halfway down flapper 102 from flapper pin 104, significant opening force is exerted on flapper pin 104, which may lead to its failure. Furthermore, unless flapper 102 and lower actuator extension 114 are manufactured very precisely and kept clean, lower actuator extension 114 will strike one contact point 116 before striking the opposite contact point 116. This imparts a rocking motion to flapper 102 and flapper pin 104, which may lead to their failure.

When deployment valve 100 is in its open position, lower actuator extension 114 has displaced flapper 102 into flapper cage 112 so that flapper 102 is flush within housing 124 and valve seat 108. Lower actuator extension 114 has essentially the same outer diameter as the inner diameter of through bore 110 (see FIG. 1) and the inner diameter of the end of tubing 118. Once deployment valve 100 is open, fluid can pass through lower actuator extension 114 and enter through bore 110 above flapper 102. When lower actuator extension 114 is returned to the position illustrated in FIG. 1, flapper spring 106 urges flapper 102 out of flapper cage 112 by inducing flapper 102 to pivot about flapper pin 104. Flapper 102 pivots until it contacts valve seat 108, thereby forming a seal perpendicular to the longitudinal axis of deployment valve 100 and closing deployment valve 100.

The prior art discloses opening a flapper valve in underbalanced drilling operations by either having an actuator engage an equalizing plunger on the valve before engaging the flapper to open the valve, or by equalizing pressure on both sides of the flapper before engaging the flapper to open the valve. Once the pressure is equalized, either by activating an equalizing plunger, or by other operations to equalize the pressure, the valve generally opens easily. But a valve that could be opened against a pressure differential would be advantageous, even if the pressure were reduced significantly so that a pressure differential approximated about 500 pounds per square inch. In such a case, the manner in which the prior art actuators engage the flapper can cause stress to the flapper hinge that could result in failure of the flapper hinge.

What is needed beyond the prior art is a flapper valve having a flapper and an actuator that does not require an equalizing plunger, that does not require pressure to be completely equalized on both sides of the flapper before engaging the flapper with an actuator in order to open the flapper, and that can maintain a seal in a reduced pressure differential environment prior to opening.

SUMMARY OF THE INVENTION

The invention that meets the needs described above consists of an improved flapper valve comprising a housing, a flapper pivotally engaged to the housing and an actuator slidingly engaged in the housing and adapted to make initial contact with the flapper at a seat end. The seat end is an area surrounding a point on a flapper bottom surface that is furthest from the location of pivotal engagement of the flapper and the housing but not in contact with the housing. The flapper closes at an acute angle to the longitudinal axis of the housing. The actuator is hollow and the interior of the actuator forms a through bore. In the closed position the flapper prevents fluid from the passing through the bore.

To open the flapper valve, the actuator presses against the seat end of the flapper to break the seal between the valve seat and the seat end so that pressure equalizes between the upper bore and the lower bore. The actuator slides forward, raising the flapper until the flapper is contained in the housing. The through bore of the actuator places the lower bore in communication with the upper bore, allowing fluid to pass between them. When the actuator moves to its starting position, the flapper is uncovered, and pivots to close the flapper valve.

BRIEF DESCRIPTION OF DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

As used herein, "fluid" means any solid, liquid, gas or combination thereof including without limitation oil, hydraulic fluid, water, high-pressure compressed air, natural gas, and slurries.

As used herein, "seat end" means an area surrounding a point on a flapper bottom surface that is furthest from a location of pivotal engagement of a flapper to a housing, but that is not in contact with the housing when the flapper is in the closed position.

The solution to the problem of a flapper valve that does not require an equalizing plunger, that does not require pressure to be completely equalized on both sides of the flapper before engaging the flapper with an actuator in order to open the flapper, and that maintains a seal in a reduced pressure differential environment is presented in two embodiments. The first embodiment, first flapper valve 200, is described in FIGS. 3-20. The second embodiment, second flapper 300, is described in FIGS. 21-30. Each embodiment also maintains a seal in a reduced pressure differential environment prior to opening.

Figure 1:
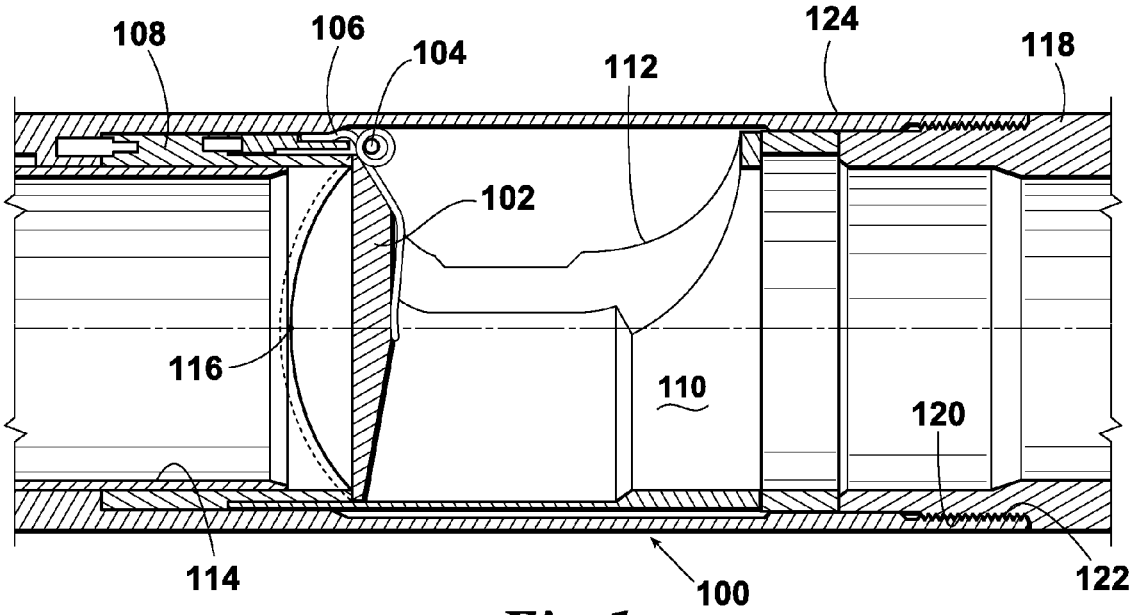
Fig. 1 ( PRIOR ART )
FIG. 1 depicts a longitudinal sectional view of a deployment valve embodying the prior art in its closed position.
Figure 2:
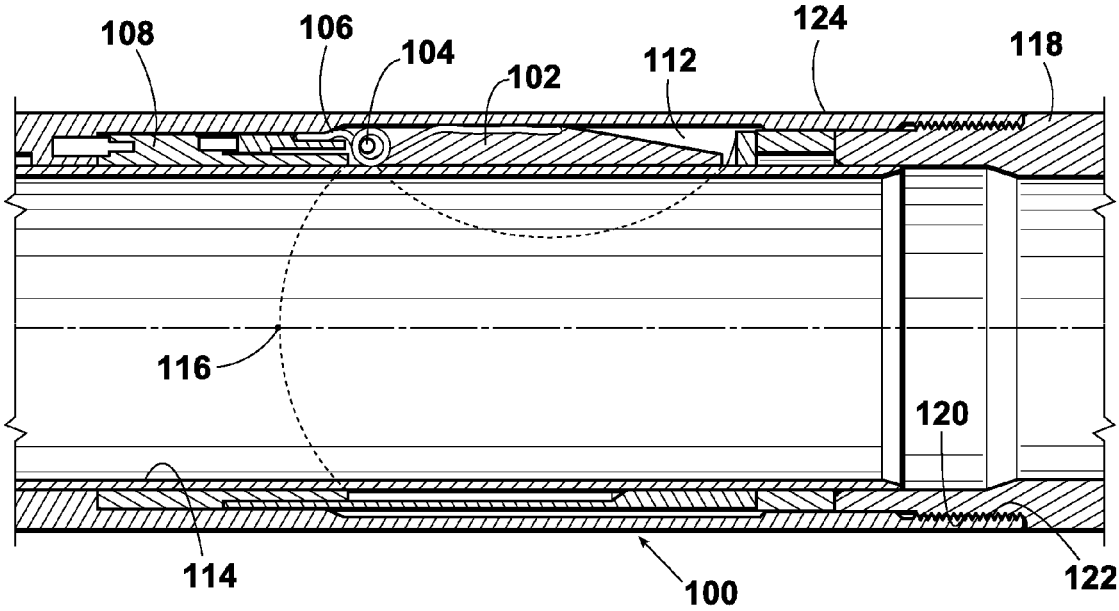
Fig. 2 ( PRIOR ART )
FIG. 2 depicts a longitudinal sectional view of the deployment valve embodying the prior art in its open position.
Figure 3:
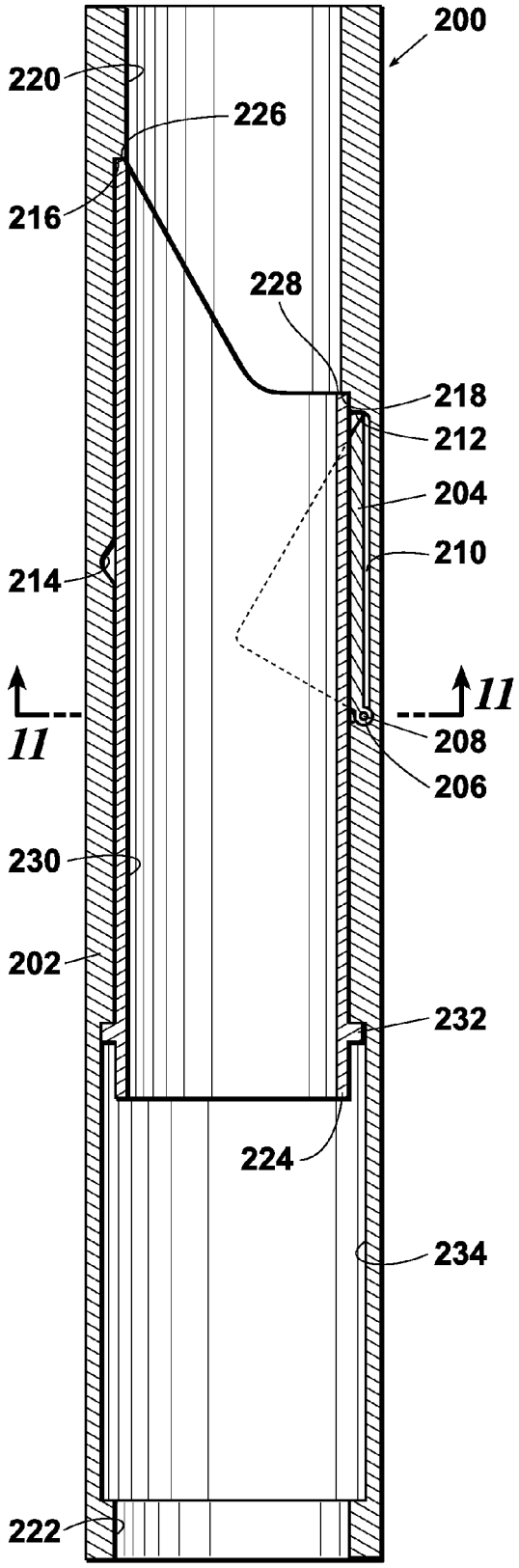
FIG. 3 depicts a longitudinal sectional view of the first flapper valve in its open position.

FIG. 3 depicts first flapper valve 200 in its open position. First flapper valve 200 has first housing 202 whose hollow interior forms upper bore 222 and lower bore 220. First actuator 224 is slidably mounted within upper bore 222. The top end of first actuator 224 terminates in tapered end 226 and blunt end 228. The lower end of first actuator 224 has first guide key 232 protruding perpendicularly from its sidewall, where it is received by first guide key slot 234 in the form of a recess formed by an enlarged bore within first housing 202. First guide key slot 234 limits the translation of first actuator 224 within first housing 202, as do first shoulder 216 and second shoulder 218. Tapered end 226 extends forward of blunt end 228 and contacts first shoulder 216 when flapper valve 200 is open. Second shoulder 218 contacts blunt end 228 when first flapper valve 200 is open. First shoulder 216 and second shoulder 218 are formed where upper bore 222 meets lower bore 220. Upper bore 222 has a larger inner diameter than lower bore 220. When viewed from the front (see FIG. 16), tapered end 226 is generally parabolic in shape. First shoulder 216 and second shoulder 218 combine to form a matching parabolic shape adapted to fit tapered end 226 when viewed longitudinally (see FIG. 5). The hollow interior of first actuator 224 forms through bore 230, allowing fluid to pass from upper bore 222 to lower bore 220 when flapper valve 200 is open. The outer diameter of first actuator 224 is essentially the same as the inner diameter of upper bore 222.

First flapper 204 is pivotably attached to first housing 202 by first flapper pin 208 inserted through spring-loaded hinge 206. When first flapper valve 200 is open, first flapper 204 resides within first flapper cage 210 flush with upper bore 222 of first housing 202. First valve seat 214, which resembles a notch when viewed from the side, is present in the sidewall of first housing 202 opposite hinge 206 to receive first seat end 202 of first flapper 204 when first flapper 204 is in its closed position.

To open first flapper valve 200, tapered end 226 of first actuator 224 strikes first seat end 212 of first flapper 204 at a single point and displaces it from first valve seat 214. First actuator 224 pivots first flapper 204 about first flapper pin 208 until first flapper 204 rests within first flapper cage 210. Because first actuator 224 strikes first flapper 204 at first seat end 212, no rocking motion is induced in hinge 206 as in the prior art. Furthermore, because actuator 224 strikes first flapper 204 at first seat end 212, first actuator 224 has more mechanical advantage compared to the prior art. This mechanical advantage reduces the opening force exerted on hinge 206 and allows first actuator 224 to open first flapper 204 when pressures are not equalized on either side of first flapper 102. In addition, first valve seat 214 stops first flapper 204 at about a 45° angle with respect to the longitudinal axis of first housing 202, thereby making first flapper 204 easier for first actuator 224 to open. Once the seal between first valve seat 214 and first seat end 212 is broken, pressures equalize, and first flapper 204 is easily opened.

Figure 4:
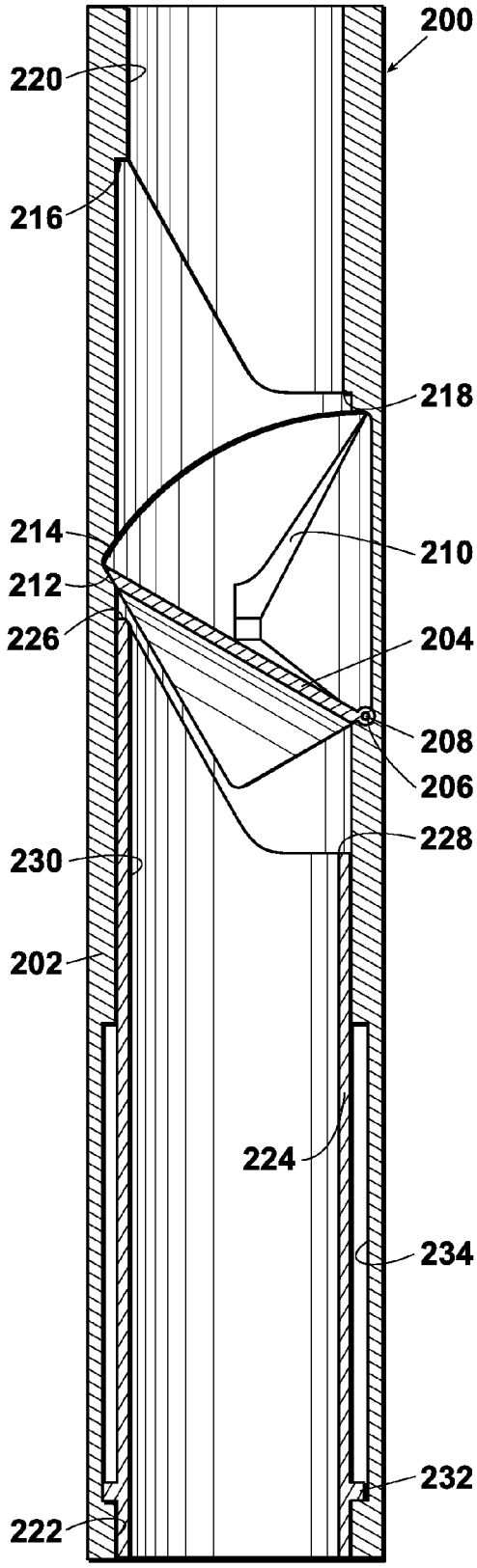
FIG. 4 depicts a longitudinal sectional view of the first flapper valve in its closed position.

FIG. 4 depicts first flapper valve 200 in its closed position. When first actuator 224 slides away from first flapper 204 until first guide key slot 234 stops the progress of first guide key 232, spring-loaded hinge 206 urges first flapper 204 to pivot about first flapper pin 208. This causes first flapper 204 to leave first flapper cage 210 and pivot until first seat end 212 contacts first valve seat 214, thereby forming a seal with first flapper 204 at about a 45° angle with respect to the longitudinal axis of first housing 202. In this position, first flapper 204 prevents the flow of fluid from lower bore 220 into upper bore 222 via through bore 230. First shoulder 216 is sufficiently displaced from second shoulder 218 so that tapered end 226 and blunt end 228 of first actuator 224 simultaneously contact first shoulder 216 and second shoulder 218, respectively. The combination of first guide key 232 and first guide key slot 234 limits the sliding motion of first actuator 224 within upper bore 222 of first housing 202. First actuator 224 has an outer diameter that is larger than the inner diameter of lower bore 220.

Figure 5:
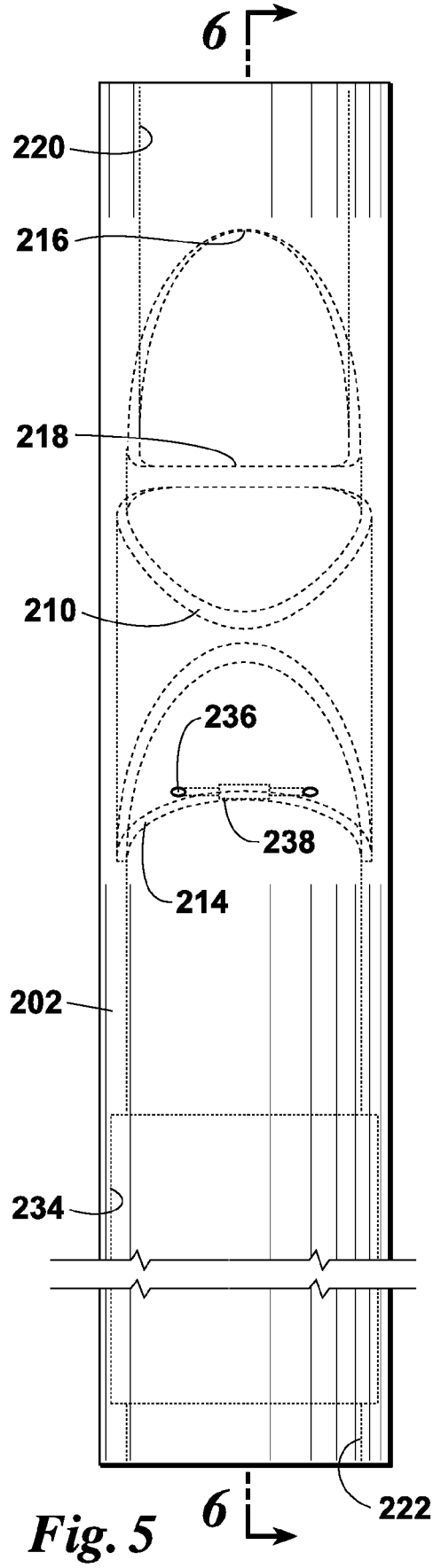
FIG. 5 depicts a longitudinal view of the first housing.

FIG. 5 depicts first housing 202. First housing 202 is hollow, forming upper bore 222 in one end and lower bore 220 in its opposing end. First shoulder 216 and second shoulder 218 are formed where upper bore 222 and lower bore 220 meet. First shoulder 216 and second shoulder 218 combine to form a generally parabolic shape when viewed from above. First shoulder 216 and second shoulder 218 are shaped to match the generally parabolic shape when viewed from above defined by tapered end 226 and blunt end 228 of first actuator 224 (not shown). First housing 202 defines first valve seat 214, flapper pin slot 236, hinge recess 238, and first guide key slot 234 as recesses in its interior sidewall in upper bore 222. First valve seat 214 is shaped to receive first seat end 212 of first flapper 204 (not shown). Hinge recess 238 receives hinge 206 (not shown), and flapper pin slot 236 receives first flapper pin 208 (not shown).

Figure 6:
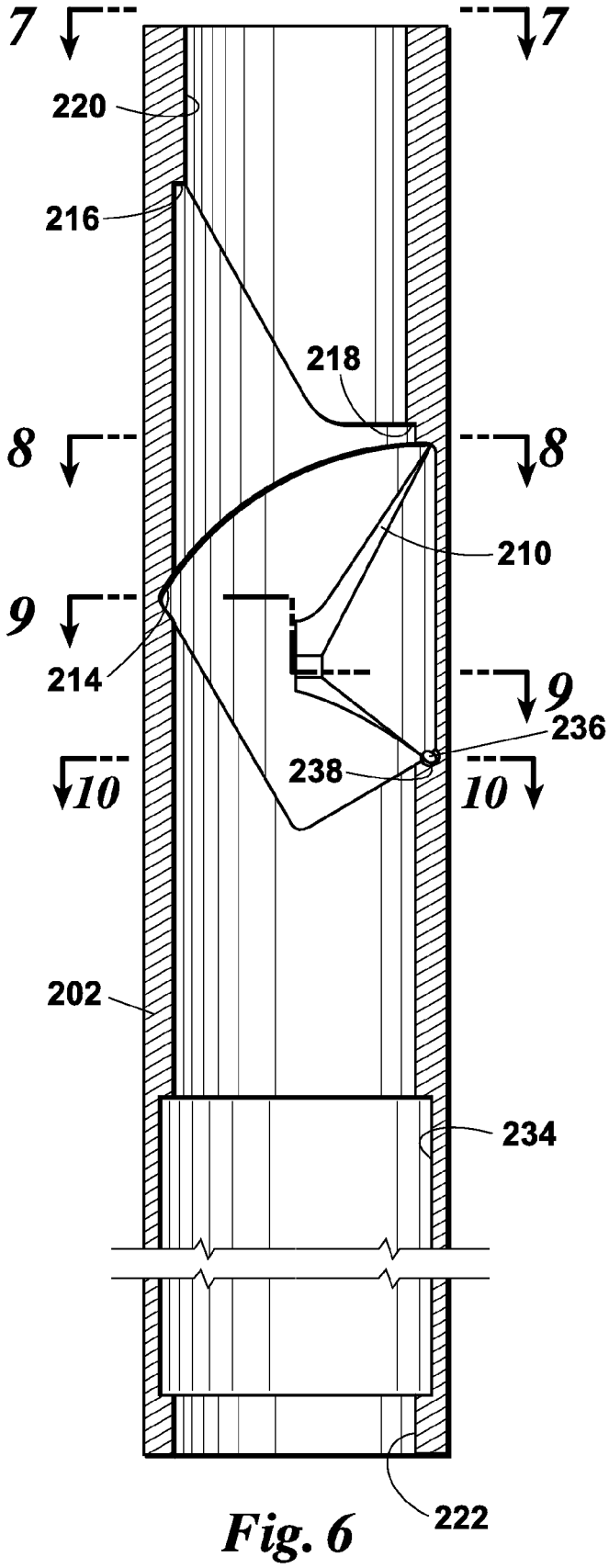
FIG. 6 depicts a longitudinal sectional view taken along line 6-6 of FIG. 5 of the first housing.

FIG. 6 depicts first housing 202. Upper bore 222 and lower bore 220 form first shoulder 216 and second shoulder 218 where they join. First shoulder 216 and second shoulder 218 are adapted to receive tapered end 226 and blunt end 228 of first actuator 224 (not shown), respectively. First flapper cage 210 is formed by a recess in first housing 202, as is first valve seat 214, hinge recess 238, flapper pin slot 236, and first guide key slot 234. First flapper cage 210 is adapted to receive first flapper 204 (not shown), hinge recess 238 is adapted to receive hinge 206 (not shown), flapper pin slot 236 is adapted to receive first flapper pin 208 (not shown), and first guide key slot 234 is adapted to receive first guide key 232 (not shown). Flapper pin slot 236 is oval in shape to allow movement of first flapper pin 208 (not shown) as rubber seal (not shown) is compressed in the closed position by pressure against first flapper 204. The use of a rubber seal to ensure a seal between the flapper and the valve seat is described in second flapper valve 300 (see FIG. 27). Alternatively, flapper pin slot 236 may be circular and hinge 206 (see FIG. 12) may be adapted to have an oblong aperture configuration to allow movement of first flapper 204 in relation to first flapper pin 208 as rubber seal (not shown) is compressed in the closed position by pressure against first flapper 204.

Figure 7:
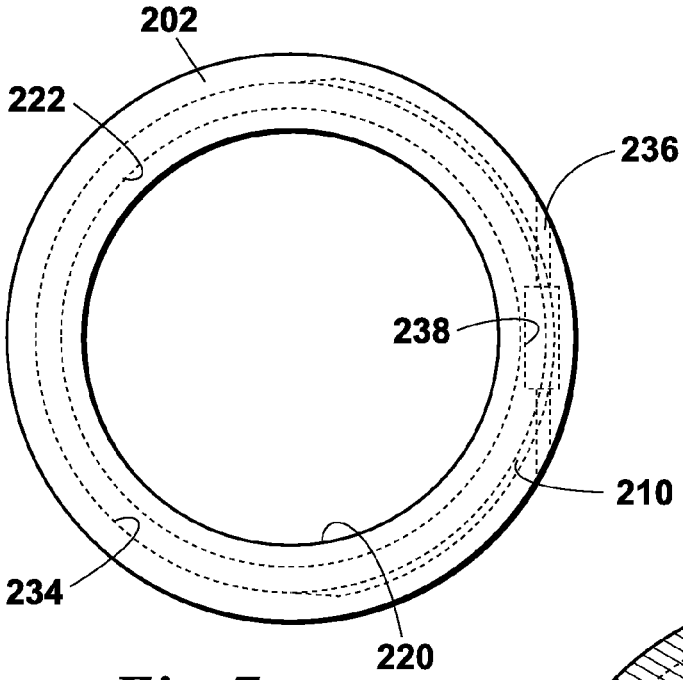
FIG. 7 is a cross-sectional view taken along line 7-7 of FIG. 6 of the first housing.

FIG. 7 depicts the top end of first housing 202. First housing 202 is hollow, forming lower bore 220 and upper bore 222. First housing 202 has recesses in its interior sidewall forming first flapper cage 210, first guide key slot 234, hinge recess 238, and flapper pin slot 236.

Figure 8:
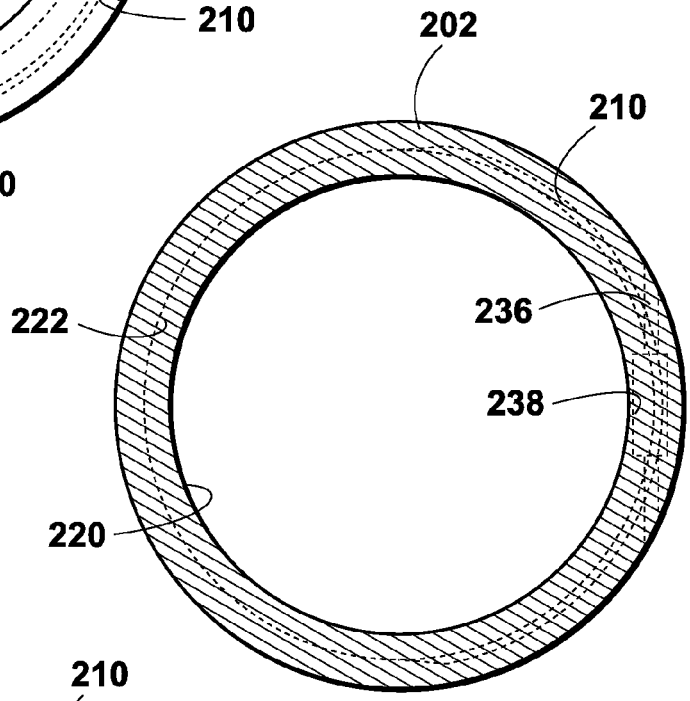
FIG. 8 is a cross-sectional view taken along line 8-8 of FIG. 6 of the first housing.

FIG. 8 depicts first housing 202 adjacent to second shoulder 218. First housing 202 is hollow, forming upper bore 222. First housing 202 has recesses in its interior sidewall forming first flapper cage 210, flapper pin slot 236, and hinge recess 238.

Figure 9:
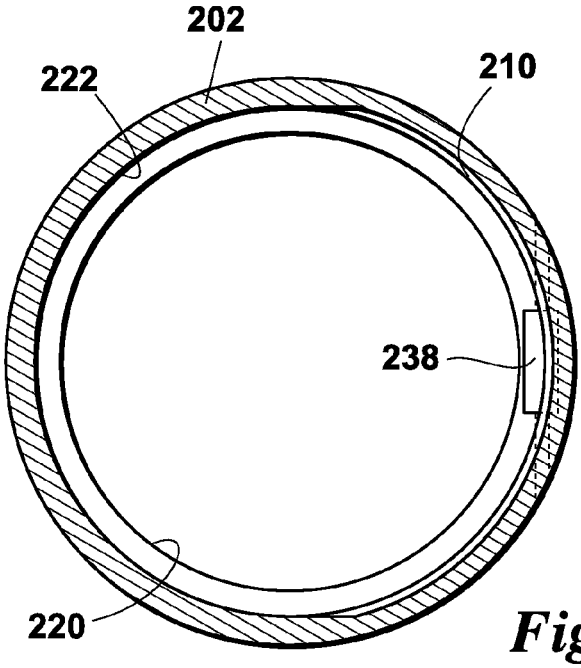
FIG. 9 is a cross-sectional view taken along line 9-9 of FIG. 6 of the first housing valve.

FIG. 9 depicts first housing 202 adjacent to first valve seat 214. First housing 202 is hollow, forming upper bore 222 and lower bore 220. First housing 202 has recesses in its interior sidewall forming first flapper cage 210 and hinge recess 238.

Figure 10:
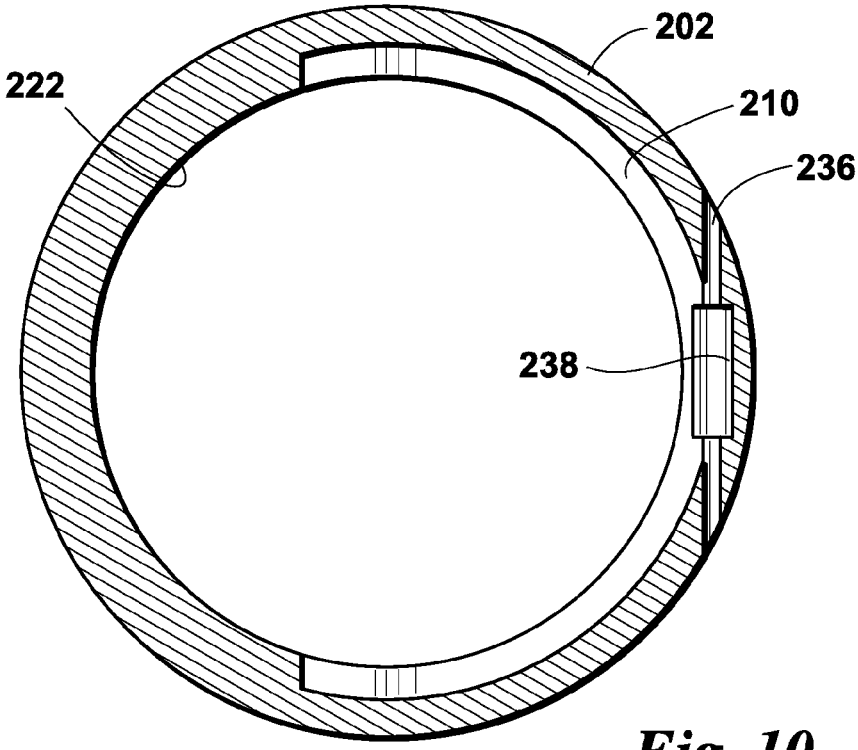
FIG. 10 is a cross-sectional view taken along line 10-10 of FIG. 6 of the first housing.

FIG. 10 depicts first housing 202 adjacent to first hinge 206. Upper bore 222 is formed by the hollow interior of housing 202. Flapper pin slot 236, hinge recess 238, and first flapper cage 210 are formed by recesses in the interior sidewall of first housing 202.

Figure 11:
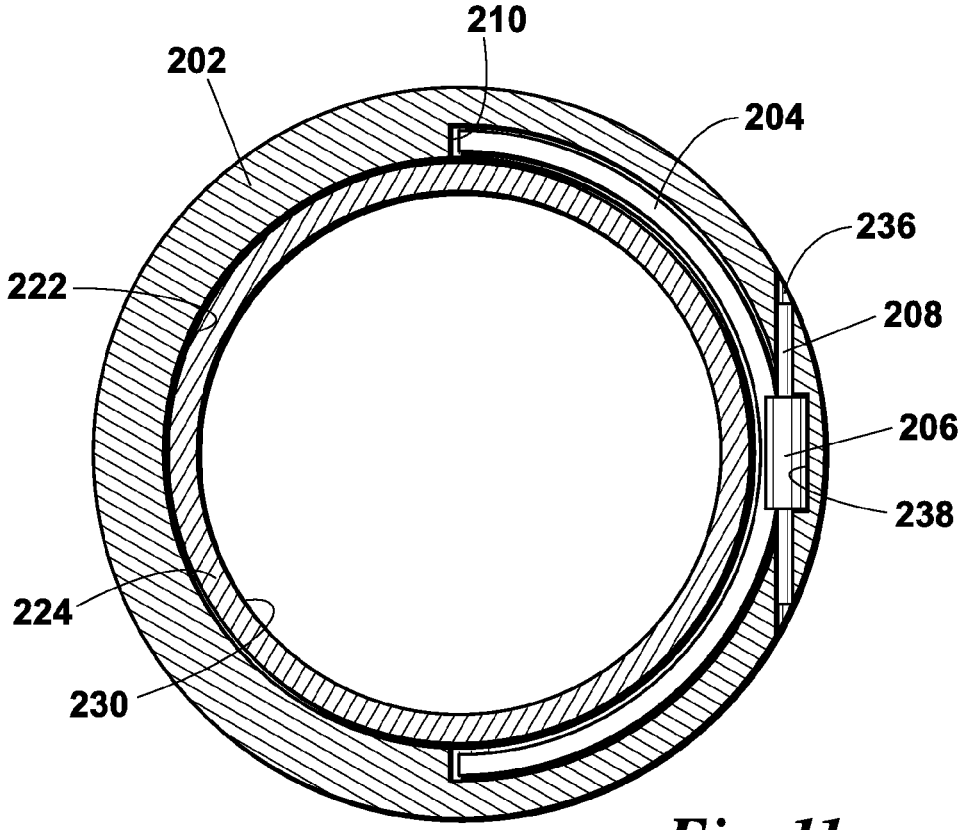
FIG. 11 is a cross-sectional view taken along line 11-11 of FIG. 3 of the first housing.

FIG. 11 depicts upper bore 222 adjacent to first hinge 206 with first flapper 204 in its open position. Upper bore 222 is formed by the hollow interior of first housing 202. Flapper pin 208 is inserted into flapper pin slot 236 and pivotably attaches spring-loaded first hinge 206 to first housing 202. Hinge recess 238 receives first hinge 206. A recess in the interior sidewall of first housing 202 forms first flapper cage 210, which is semicircular in cross-section and receives first flapper 204 in its open position. First flapper 204 is flush with respect to upper bore 222 when located within first flapper cage 210 and is also semicircular in cross-section. First actuator 224 displaces first flapper 204 into first flapper cage 210 and has a hollow interior forming through bore 230.

Figure 12:
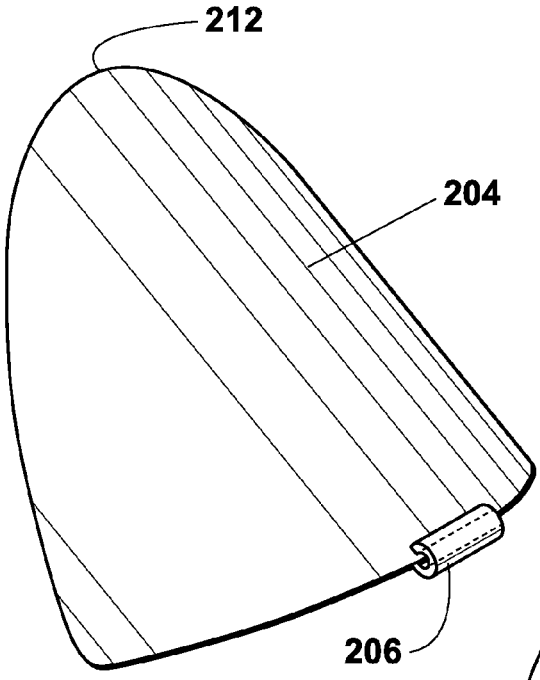
FIG. 12 is a top perspective view of the first flapper.

FIG. 12 depicts first flapper 204. First flapper 204 has first hinge 206 attached at one end and tapers at its opposing end to form first seat end 212. First flapper 204 is generally parabolic in shape when viewed from the side at elevation.

Figure 13:
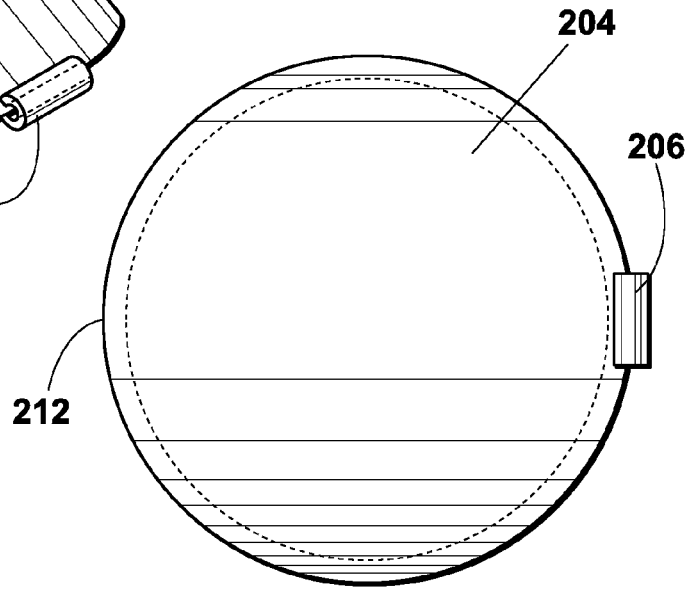
FIG. 13 is a top view of the first flapper.

FIG. 13 depicts first flapper 204. First flapper 204 has first hinge 206 at one end and forms first seat end 212 at its opposing end. First flapper 204 is generally circular in shape when viewed from above.

Figure 14:
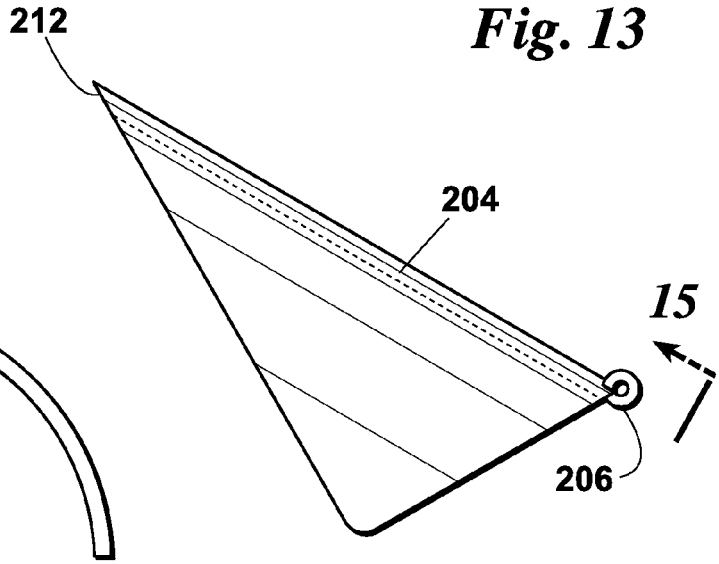
FIG. 14 is a left side view of the first flapper.

FIG. 14 depicts first flapper 204. First flapper 204 has first hinge 206 at one end and forms first seat end 212 at its opposing end. First flapper 204 is generally triangular in shape when viewed from the side.

Figure 15:
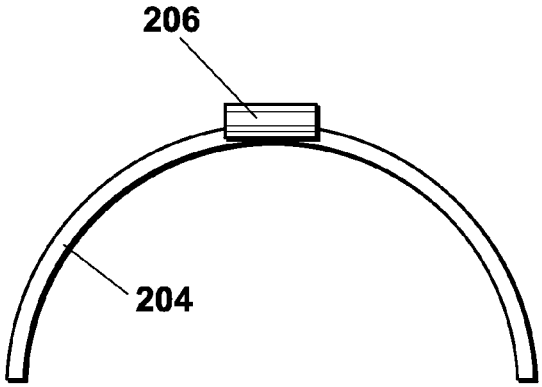
FIG. 15 is a rear view of the first flapper.

FIG. 15 depicts first flapper 204. First flapper 204 has first hinge 206 attached to its rear. First flapper 204 is semicircular in shape when viewed from its rear, with an outer diameter substantially the same as the inner diameter of first flapper cage 210 (see FIG. 3) and an inner diameter substantially the same as the inner diameter of upper bore 222 (see FIG. 3).

Figure 16:
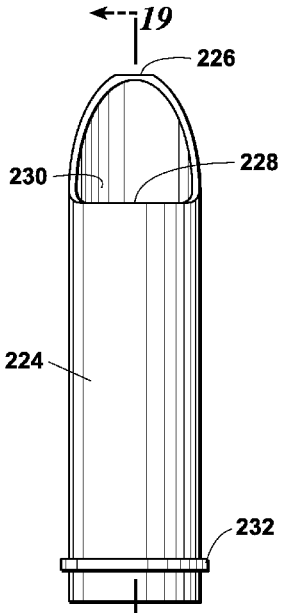
FIG. 16 is a front elevational view of the first actuator.

FIG. 16 depicts first actuator 224. First actuator 224 is hollow, forming through bore 230, and has first guide key 232 protruding perpendicularly as a flange from its external sidewall at one end. Its opposing end terminates in blunt end 228 and tapered end 226. Tapered end 226 protrudes beyond blunt end 228, forming an opening that is generally parabolic in shape when viewed from above.

Figure 17:
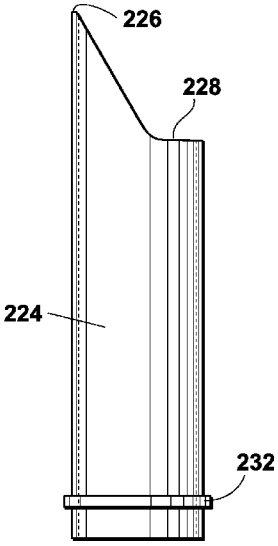
FIG. 17 is a left side view of the first actuator.

FIG. 17 depicts first actuator 224. First actuator 224 terminates in tapered end 226 and blunt end 228 at one end with first guide key 232 attached to its exterior adjacent to its opposing end.

Figure 18:
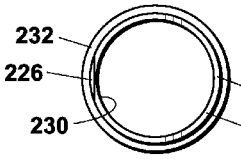
FIG. 18 is a top view of the first actuator.

FIG. 18 depicts first actuator 224. First actuator 224 is hollow, forming through bore 230, and has first guide key 232 protruding perpendicularly from its external sidewall. First actuator 224 is circular in cross-section with an inner diameter substantially the same as lower bore 220 and an outer diameter substantially the same as upper bore 222.

Figure 19:
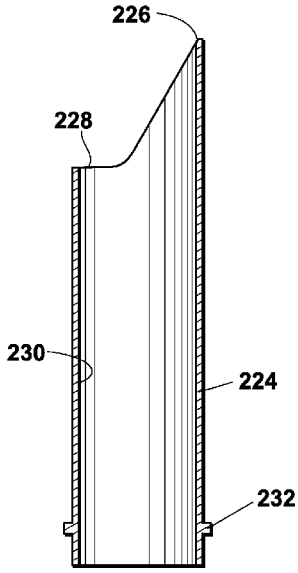
FIG. 19 depicts a longitudinal sectional view taken along line 19-19 of FIG. 16 of the first actuator.

FIG. 19 depicts first actuator 224. First actuator 224 forms through bore 230 in its interior and terminates in blunt end 228 and tapered end 226 at one end. First guide key 232 protrudes from its sidewall adjacent to its opposing end.

Figure 20:
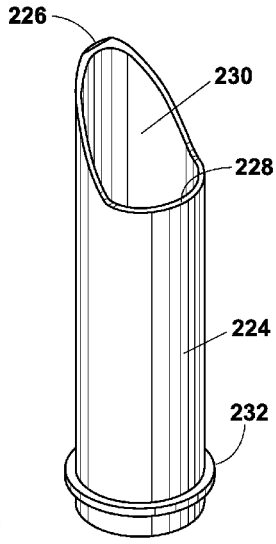
FIG. 20 is a top perspective view of the first actuator.

FIG. 20 depicts first actuator 224. First actuator 224 terminates in tapered end 226 and blunt end 228 that define a generally parabolic opening that provides access to through bore 230 in the interior of first actuator 224. First guide key 232 is attached to the exterior of first actuator 224 adjacent to the end of first actuator 224 opposite the parabolic opening.

Figure 21A:
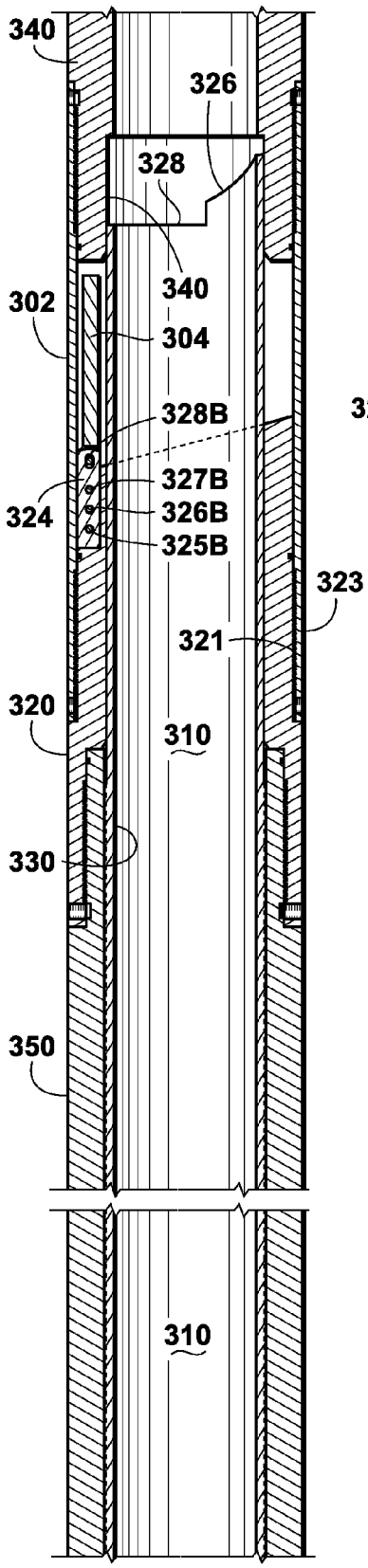
FIG. 21A-21C is a longitudinal view of the second flapper valve with the second actuator in an open position.
Figure 22A:
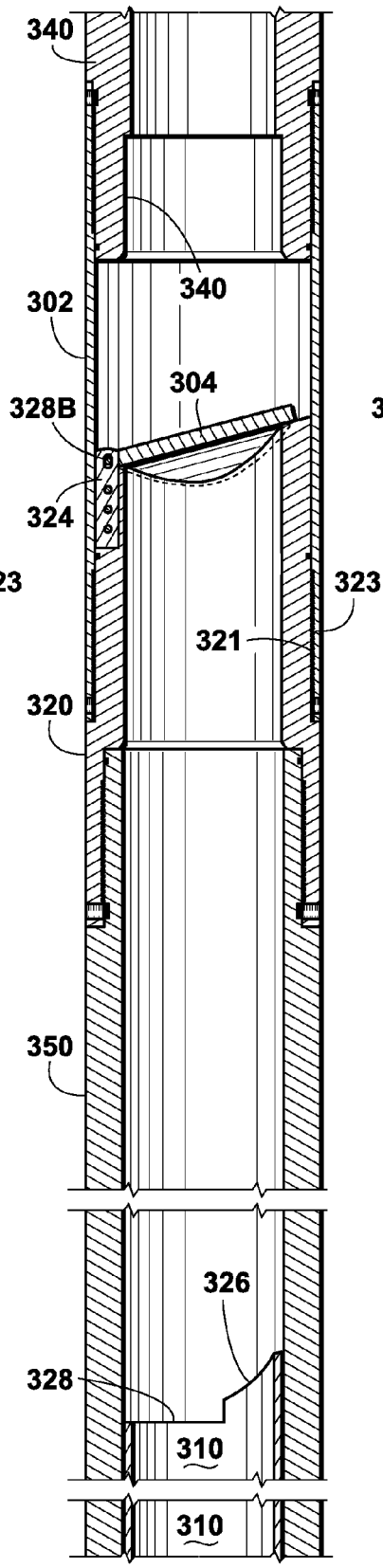
FIG. 22A-22C is a longitudinal view of the second flapper valve with the second flapper in a closed position.
Figure 23A:
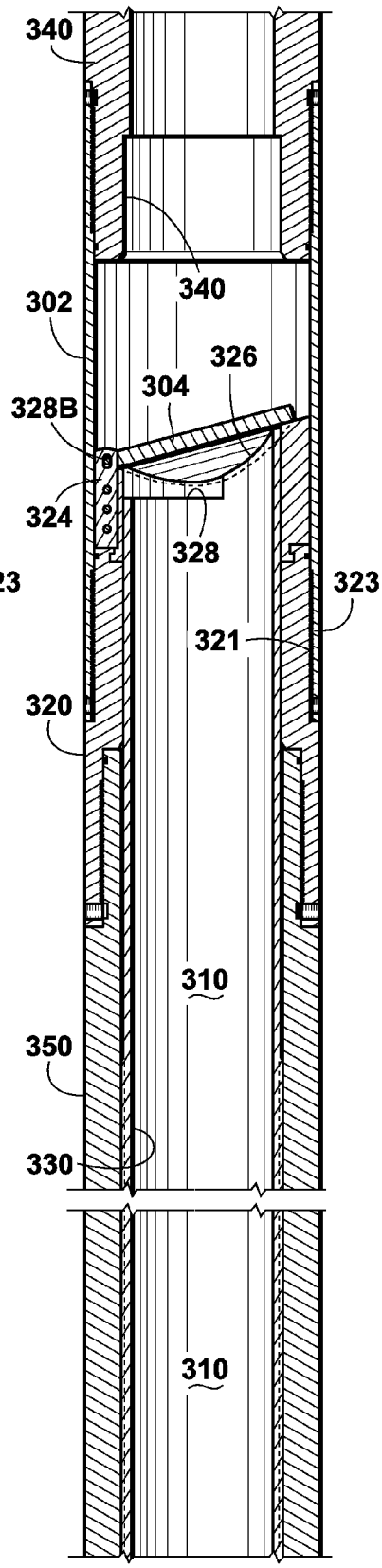
FIG. 23A-23C is a longitudinal view of the second flapper valve with the second flapper in a closed position and the second actuator retracted.
Figure 21B:
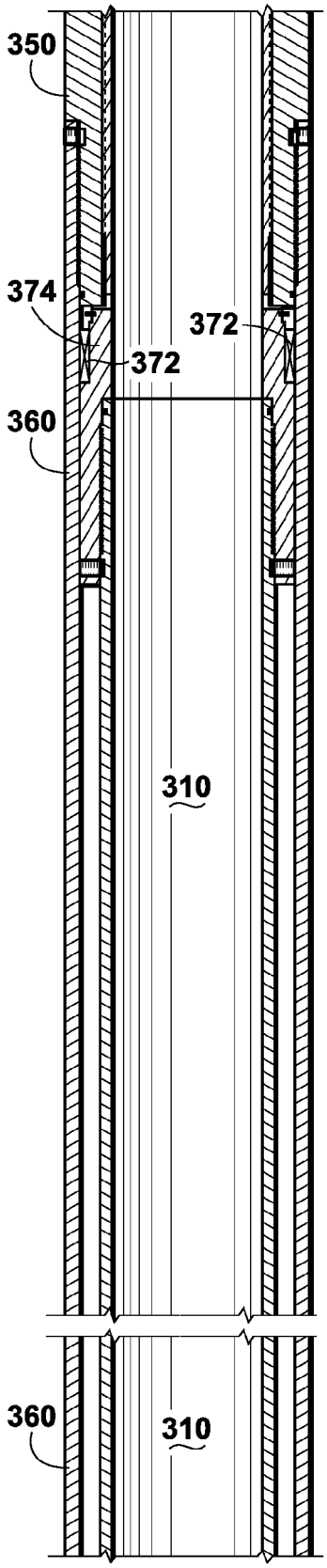
Figure 22B:
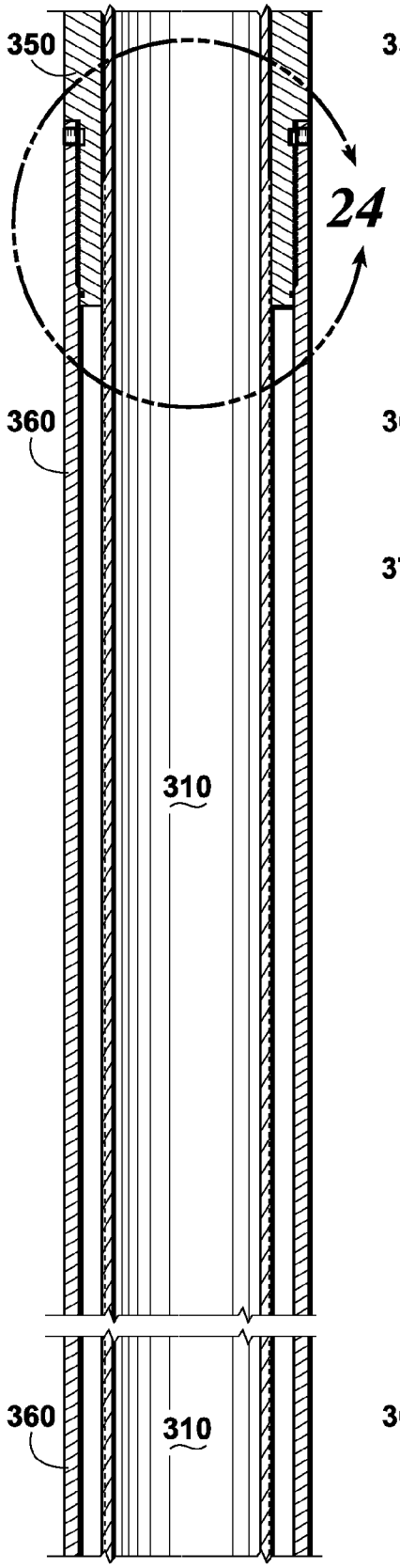
Figure 23B:
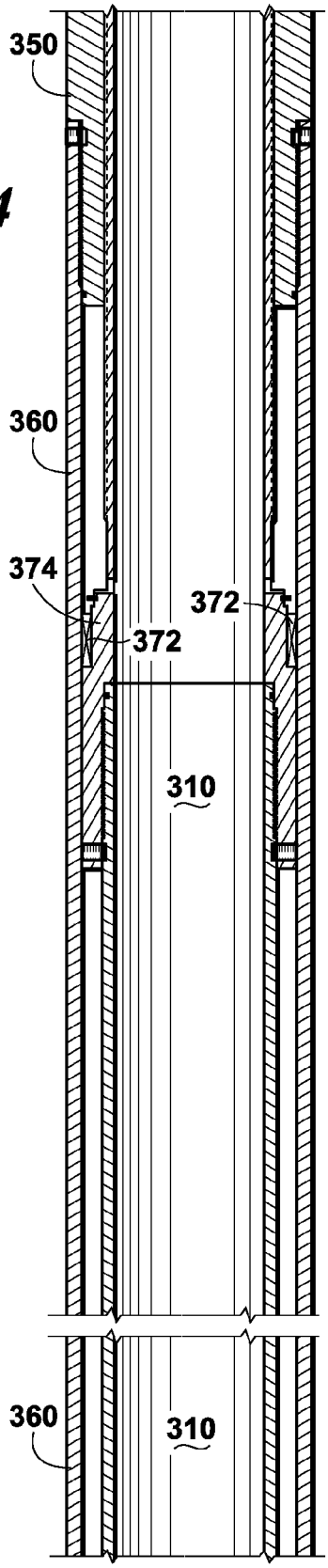
Figure 21C:
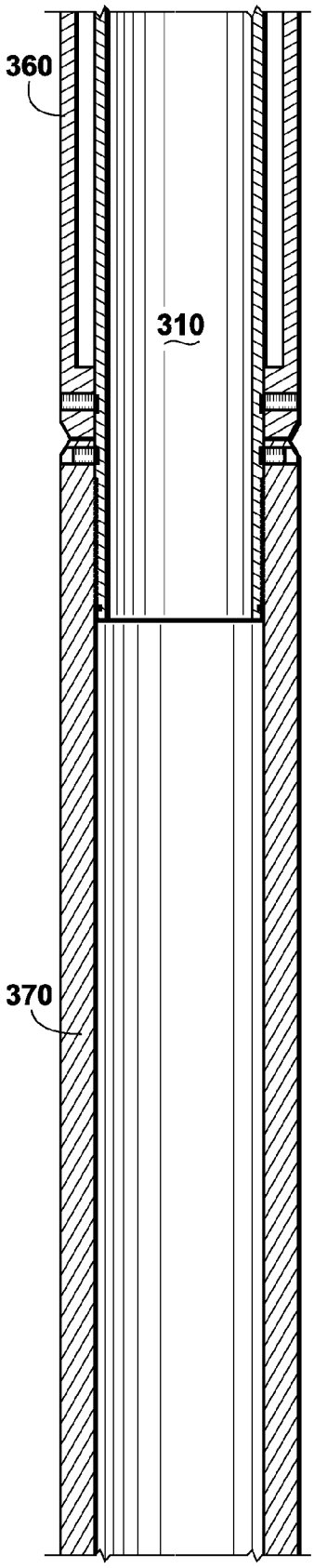
Figure 22C:
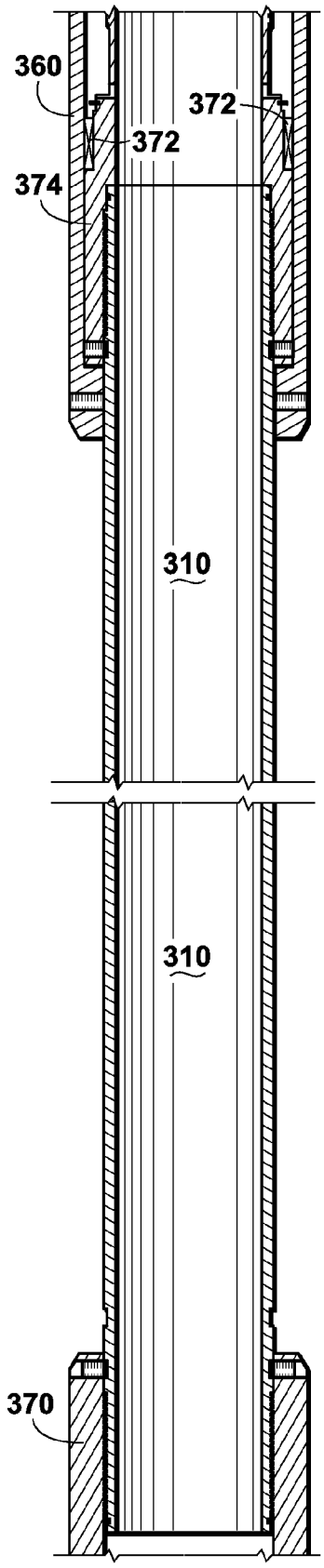
Figure 23C:
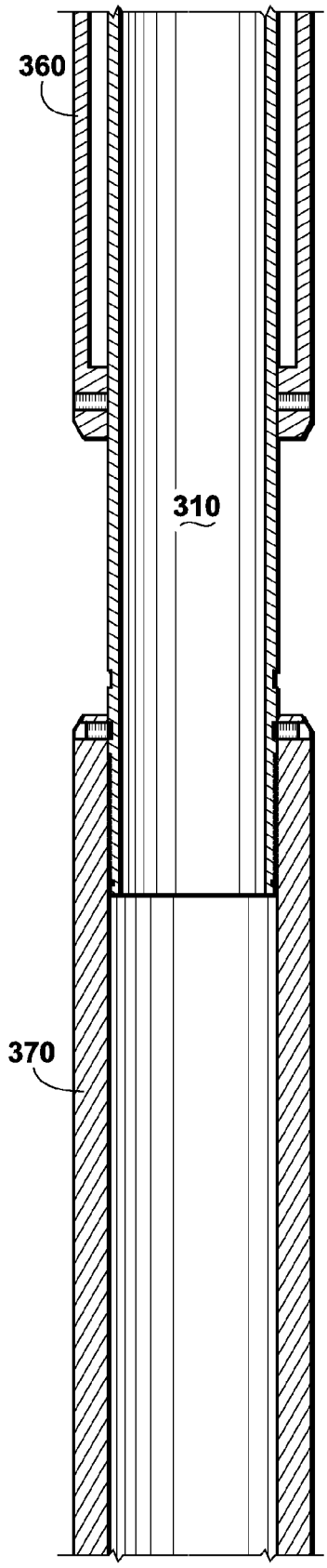

FIGS. 21A-21C, 22A-22C, and 23A-23C depict second flapper valve 300, with second flapper 304 and second actuator 310. FIGS. 21A-21C depict second flapper 304 in an open position and second actuator 310 extended past second flapper 304. FIGS. 22A-22C depict second flapper 304 in a closed position with second actuator 310 retracted. FIGS. 23A-23C depict second flapper 304 in a closed position with second actuator 310 extended so that into contact with second flapper 304. Referring to FIGS. 21A, 21B and 21C through 23A, 23B and 23C, second actuator 310 has horizontal face 328 and angled face 326. When second actuator 310 is extended to contact second flapper 304, angled face 328 contacts second flapper 304 so that, at initial contact, approximately the entire surface of angled face 328 contacts a portion of the bottom of second flapper 304. Second flapper 304 is pivotally engaged to inner housing 320 by bar 324 and second hinge pin 328B (see also FIG. 27). Outer housing 302 is threadably engaged to inner housing 320 and forms a recess into which second flapper 304 fits when moved to a recessed position by actuator 310.

Outer housing 302 is threadably engaged to first casing 340. Inner housing 320 is threadably engaged to second casing 350. Second casing 350 is threadably engaged to third casing 360. Fourth casing 370 is threadably engaged to the end of actuator 310. Movement of fourth casing 370 causes actuator 310 to extend or retract. Second actuator 310 is hollow and has inner surface 330. Stopper 374 is threadably engaged to actuator 310 so that, when actuator 310 is fully retracted, stopper 374 contacts third casing 360. Seal 372 is positioned between stopper 374 and third casing 360.

Figure 24:
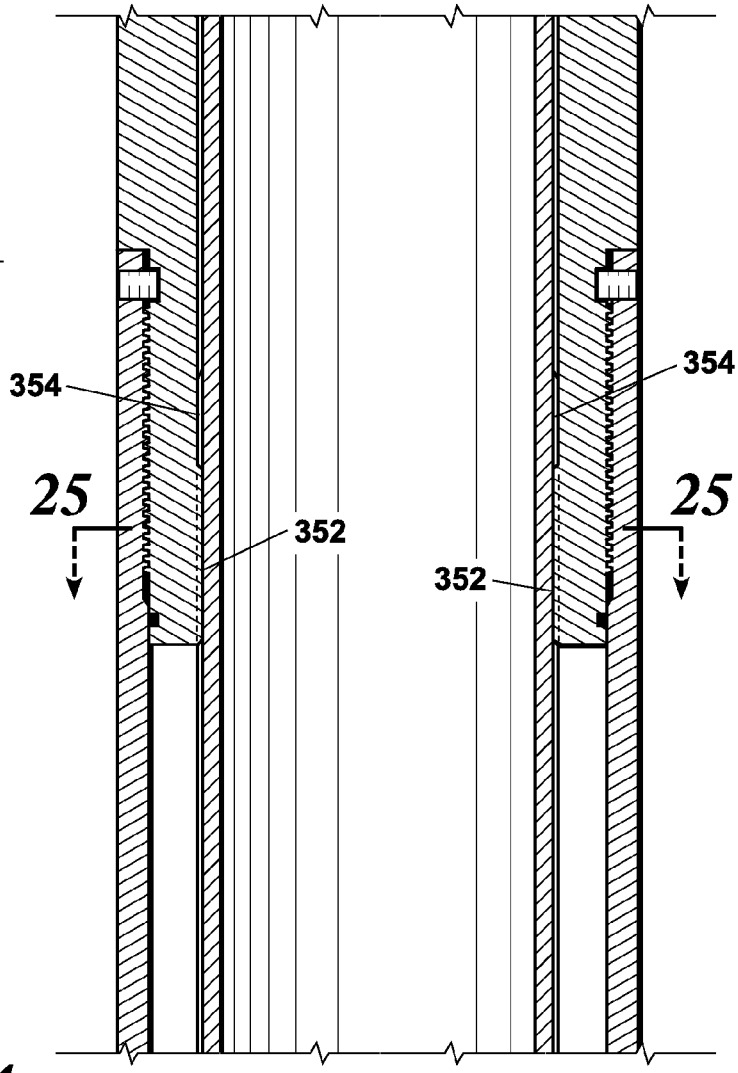
FIG. 24 is an expanded longitudinal cross sectional view of a portion of the second flapper valve of FIG. 22B.

FIG. 24 is an enlarged view of a portion of second flapper valve 300 of FIG. 22B showing second guide keys 352 which travel in second guide key slots 354.

Figure 25:
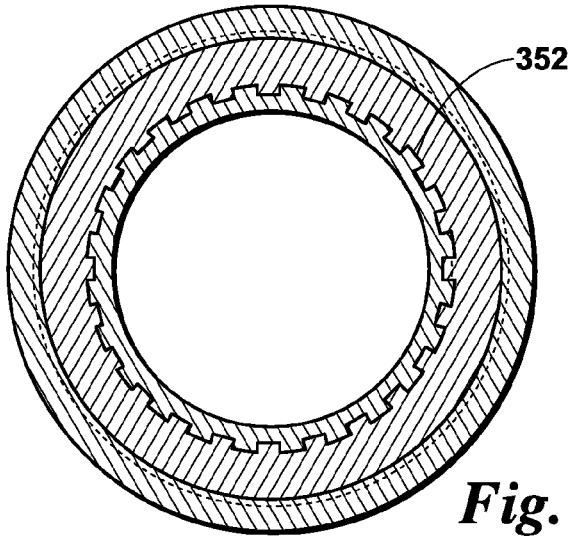
FIG. 25 is a cross sectional view of the second flapper valve taken along line 25-25 of FIG. 24.

FIG. 25 is a cross sectional view showing second guide keys 352. Second guide keys 352 track in second guide key slots 354 (see FIG. 24) to ensure that second actuator 310 is always oriented so that second actuator 310 will engage second flapper 304 with substantially all of angled face 326 at initial contact, and additionally, so that the midpoint of angled face 326 will engage second flapper 304 at the point furthest from the location of the pivotal engagement of the second flapper to the housing. In other words, the midpoint of angled face 326 will engage the seat end of second flapper 304. In one embodiment, second flapper valve 300 has ninety (90) second guide keys and ninety (90) second guide key slots; however, persons skilled in the art recognize that either more or less guide keys and more or less guide key slots may be utilized. Using a large number of guide keys and guide key slots provides at least two advantages. First, a large number of guide keys and guide key slots ensure that the center of angled face 326 contacts the seat end of second flapper 304. Second, a large number of guide keys and guide key slots promote interoperability by ensuring that one second actuator 310 can be exchanged for another second actuator 310 without any variation in the capability of second actuator 310 to engage second flapper 304 with the center of angled face 326 engaging the seat end of second flapper 304. Persons skilled in the art will understand that the optimum number of second guide keys and second guide key slots will vary depending on the materials used to construct the second flapper valve and upon the operating conditions for which the second flapper valve is designed.

Figure 26:
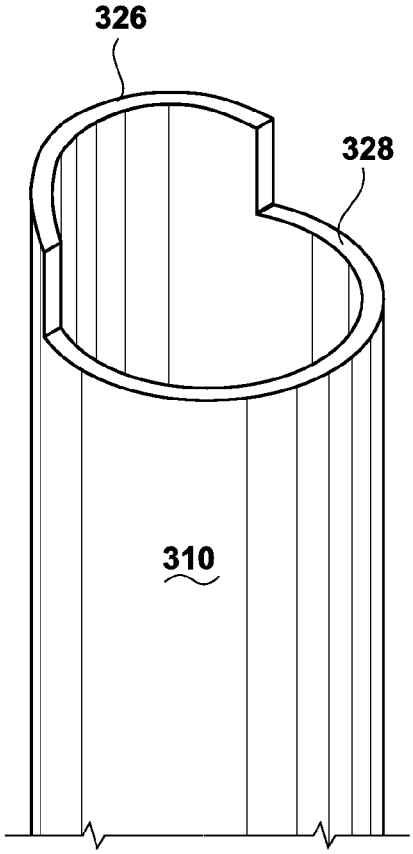
FIG. 26 is a side perspective view of the second actuator.

FIG. 26 depicts second actuator 310 with angled face 326 and horizontal face 328. Angled face 326 slopes downward at an angle corresponding to the angle of second flapper 304 when second flapper 304 is seated in a closed position. Angled face 326 is designed to contact a bottom surface area of second flapper 304 centered on the seat end of second flapper 304.

Figure 27:
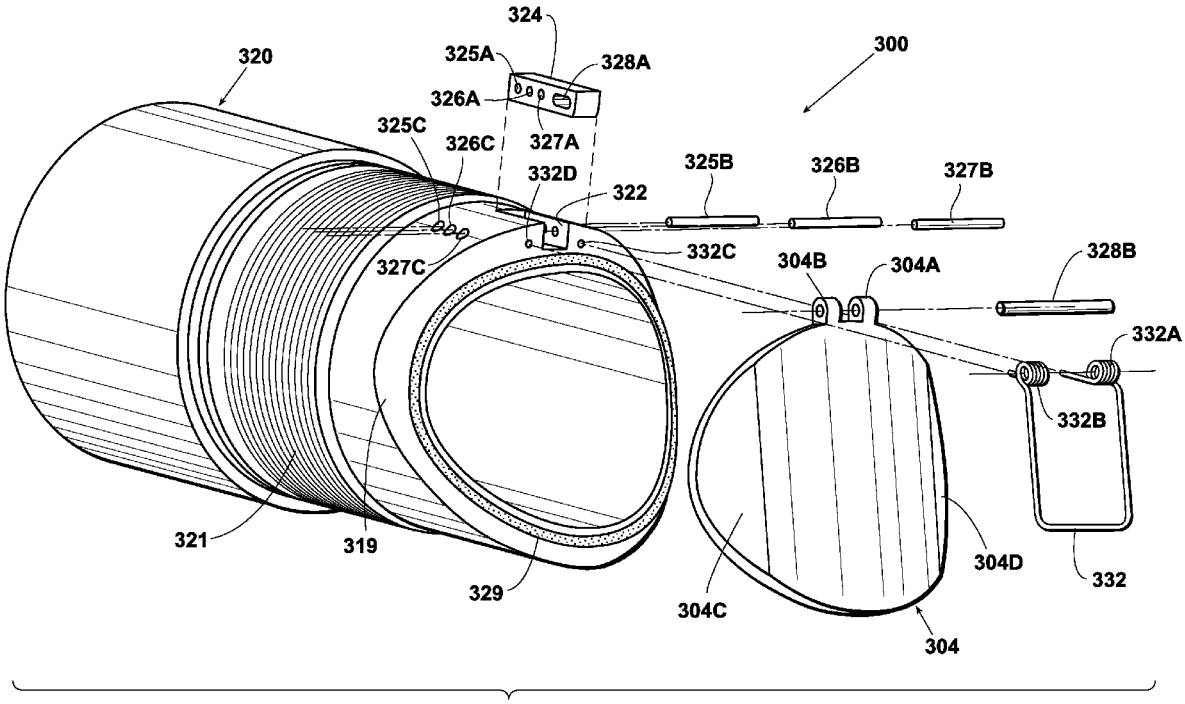
FIG. 27 is an exploded perspective view of the second flapper valve.

FIG. 27 depicts an exploded view of a portion of second flapper valve 300. Inner housing 320 is shown without engagement to outer housing 302 removed so that male threads 321 for engaging female threads 323 of outer housing 302 are exposed. Inner housing 320 has first channel 325C, second channel 326C, and third channel 327C. Inner housing 320 has inner housing slot 322 for receiving bar 324. Bar 324 has first aperture 325A, second aperture 326A, and third aperture 327A. In addition bar 324 has oblong hinge slot 328A for receiving second hinge pin 328B. Bar 324 fits into inner housing slot 322 so that first aperture 325A, second aperture 326A, and third aperture 327A align with first channel 325C, second channel 326C and third channel 327C so that first bar pin 325B, second bar pin 326B, and third bar pin 327B can be inserted therein to secure bar 324 within inner housing 320. When secured within inner housing 320, bar 324 extends out of inner housing slot 322 so that oblong hinge slot 328A is positioned to receive second hinge pin 328B. Second flapper 304 has first flapper hinge section 304A and second flapper hinge section 304B, each having an aperture with an internal diameter approximately that of the diameter of second hinge pin 328B. Spring 332 has first spring tang section 332A and second spring tang section 332B. First spring tang section 332A and second spring tang section 332B receive second hinge pin 328B, and also seat in first spring receptacle 332C and second spring receptacle 332D respectively.

Second flapper valve 300 is assembled, in part, by placing flapper 304 so that first flapper hinge section 304A and second flapper hinge section 304B are aligned on either side of bar 324, and by placing spring 332 so that first spring tang section 332A and second spring tang section 332B are on either side of first flapper hinge section 304A and second flapper hinge section 304B respectively so that second hinge pin 328B can be inserted for passage through first spring tang section 332A, first flapper hinge section 304A, oblong hinge slot 328A of bar 324, second flapper hinge section 304B and second hinge tang section 332B. First bar pin 325B, second bar pin 326B, third bar pin 327B and second hinge pin 328B are held in place by outer housing 302 when it is screwed onto inner housing 320. Rubber seal 329 encircles an inner portion of inner housing valve end 319. Rubber seal 329 engages the overlapping portion of second flapper 304 when pivotally engaged to inner housing 320. Oblong hinge slot 328A provides room for second hinge pin 328 to move in response to compression of rubber seal 329. First spring receptacle 332C and second spring receptacle 332D allow movement of first spring tang section 332A and second spring tang section 332B in accordance with movement of second hinge pin 328 in oblong hinge slot 328A. The pressure against flapper 304 may vary from 2000 psi or more to approximately 500 psi prior to opening and for the seal formed by second flapper 304 against rubber seal 329 on inner housing valve end 319, oblong hinge slot is required to give second hinge pin 328 room to move in response to the changes in compression of rubber seal 329.

Figure 28:
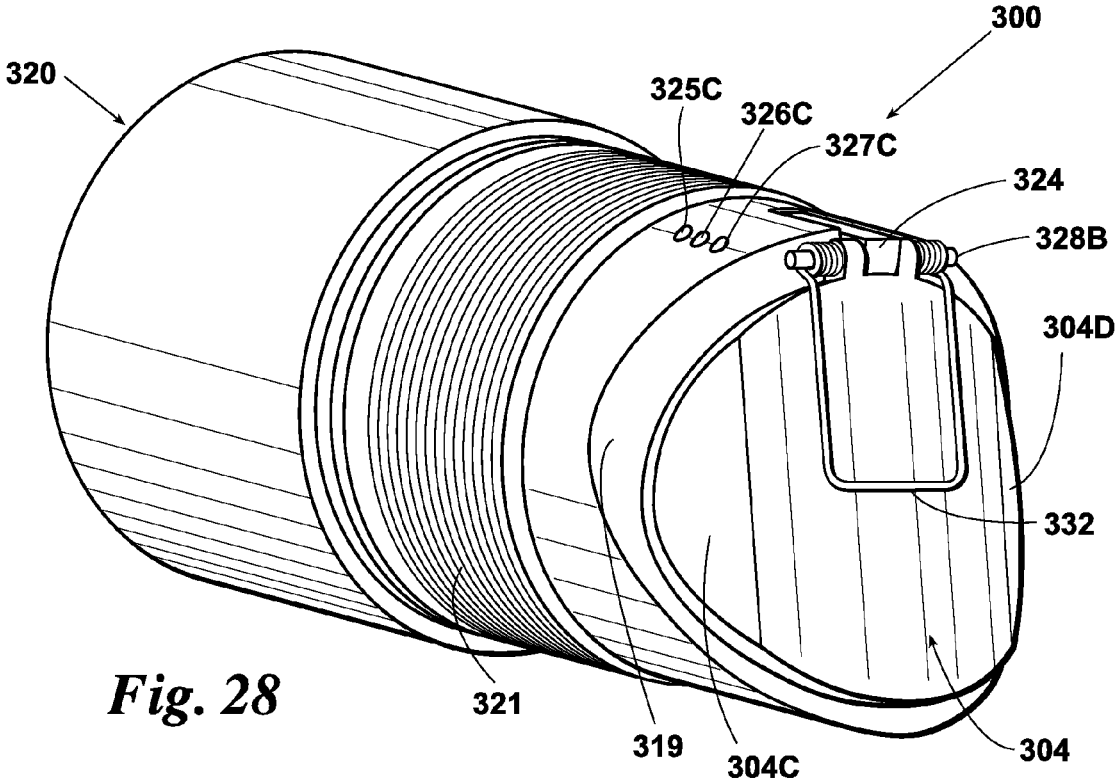
FIG. 28 is a front perspective view of the second flapper valve.

FIG. 28 depicts second flapper valve 300 assembled as described above. Spring 332 exerts pressure against second flapper 304 to hold second flapper in sealed contact with inner housing 320 by engaging rubber seal 329.

Figure 29:
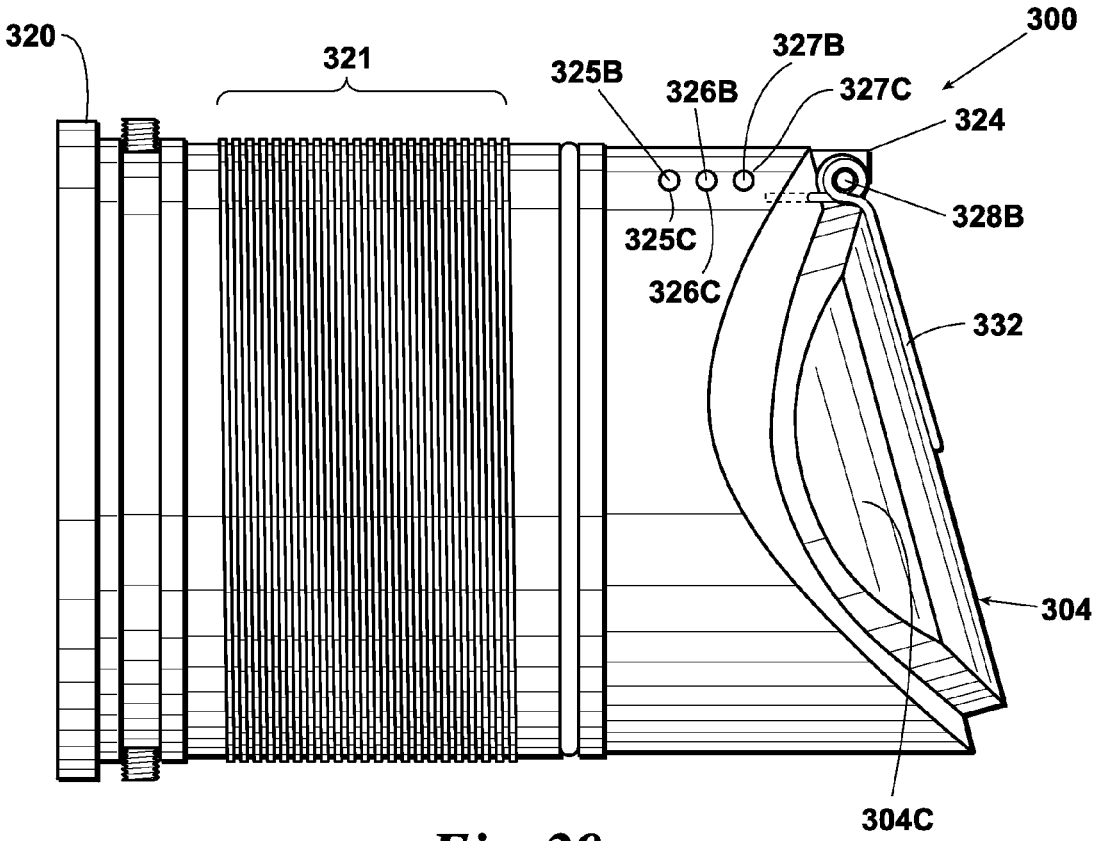
FIG. 29 is a side view of the second flapper valve.

FIG. 29 depicts a side view of the portion of second flapper valve 300 comprising inner housing 320, second flapper 304, spring 332, bar 324, second hinge pin 328B, and first bar pin 325B, second bar pin 326B and third bar pin 327B.

Figure 30A:
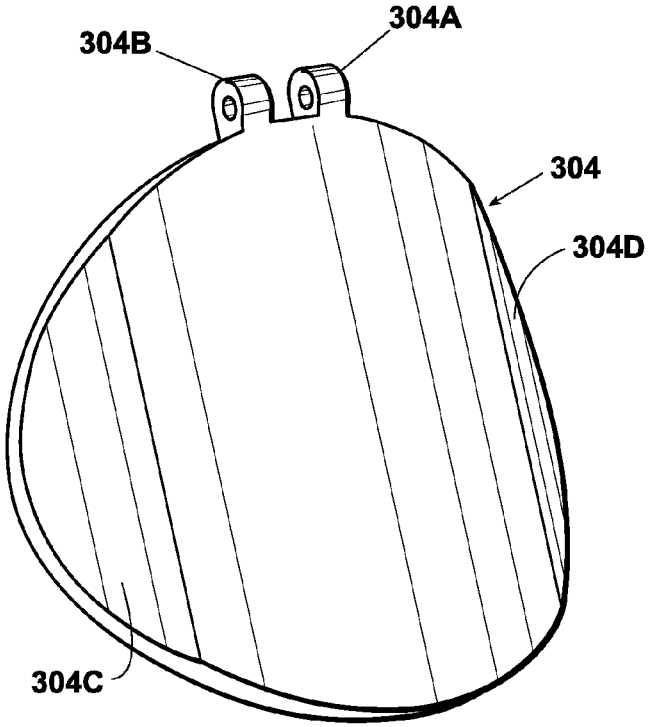
FIG. 30A is a front perspective view of the second flapper.
Figure 30B:
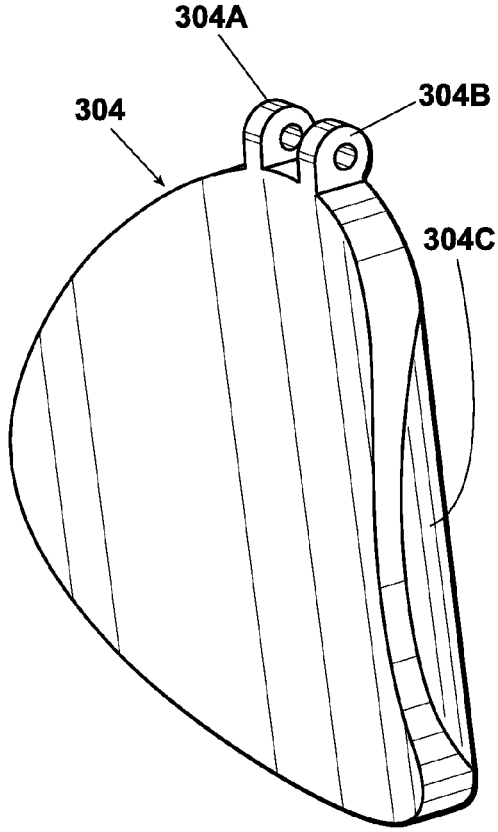
FIG. 30B is a rear perspective view of the second flapper.
Figure 30C:
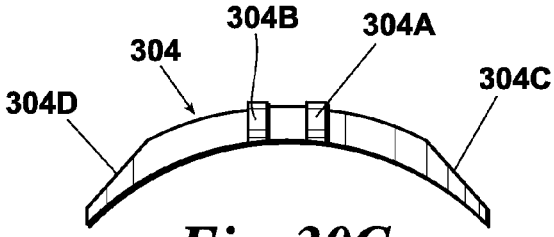
FIG. 30C is a top view of the second flapper.
Figure 30D:
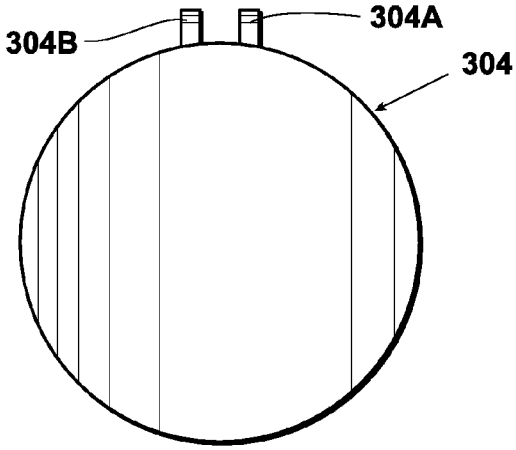
FIG. 30D is a front view of the second flapper.
Figure 30E:
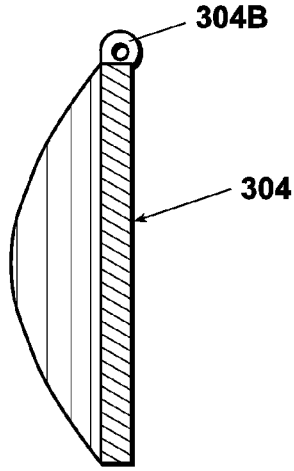
FIG. 30E is a cross sectional view of the second flapper.

FIGS. 30A-FIG. 30E depict different views of second flapper 304 in order to show the curved shape of second flapper 304 and modifications to the shape of second flapper valve that are necessary so that second flapper valve 304 will conform to the interior of outer housing 302. FIG. 30A is a front perspective view of second flapper valve 304 showing a concave outer surface. FIG. 30B is a rear perspective view of second flapper 304 showing a concave inner surface. FIG. 30C depicts a top view of second flapper 304 showing first modified area 304C and second modified area 304D. FIG. 30D is a front view of second flapper 304 showing the circular outline of second flapper valve from that perspective, and FIG. 30E depicts a cross section view of second flapper 304.

Persons skilled in the art will recognize that operation of the flapper valve and actuator can be enhanced by controlling the pressure differential between the upper bore and the lower bore. For example if lower bore pressure is 2000 psi, upper bore pressure can be raised to 1500 psi before the actuator is moved to contact the flapper valve. The configuration of flapper valve permits a pressure differential of approximately 500 psi when opening flapper with actuator.

With respect to the above description, it is to be realized that the optimum dimensional relationships for the parts of the invention, to include variations in size, materials, shape, form, function, manner of operation, assembly, and use are deemed readily apparent and obvious to one of ordinary skill in the art. The present invention encompasses all equivalent relationships to those illustrated in the drawings and described in the specification. The novel spirit of the present invention is still embodied by reordering or deleting some of the steps contained in this disclosure. The spirit of the invention is not meant to be limited in any way except by proper construction of the following claims.

What is claimed is:

1. An apparatus comprising:

a housing;

a flapper pivotally engaged to the housing; and an actuator slidingly engaged in the housing and adapted to make initial contact with the flapper at a seat end;

a closed position of the flapper at an acute angle to a longitudinal axis of the housing adapted to prevent fluid from a lower bore from entering an upper bore; and a first end and a second end of the actuator, the second end terminating in a contact surface adapted to press against the seat end of the flapper when the flapper is in the closed position so that a pressure differential between the upper bore and the lower bore is reduced;

wherein the seat end is an area surrounding a point on a bottom surface of the flapper, that is furthest from a location of pivotal engagement of the flapper and the housing, but not in contact with an inner wall of the housing.

2. The apparatus of claim 1 further comprising:

a housing adapted for movement of the actuator from a first position to a second position so that when the actuator is in the second position, the flapper is open.

3. The apparatus of claim 2 wherein the housing further comprises a recess adapted to contain the flapper when the flapper is open.

4. The apparatus of claim 2 further comprising:

a guide key attached to the actuator and protruding into a guide key slot in the housing adapted to orient the actuator.

5. The apparatus of claim 2 further comprising:

a plurality of guide keys attached to the actuator and adapted to engage a plurality of guide key slots in the housing.

6. The apparatus of claim 2 further comprising:

a hinge connected to an end of the flapper and pivotally engaged to the housing.

7. The apparatus of claim 2 further comprising:

a bar adapted for engagement to an inner housing wherein the bar has an oblong aperture adapted to receive a hinge pin.

8. The apparatus of claim 7 wherein the oblong aperture allows movement of the hinge pin so that the flapper can move in response to a compression of a rubber seal.

9. The apparatus of claim 1 wherein the contact surface comprises an angled face adapted to contact the flapper so that at initial contact approximately an entire surface of the angled face contacts a portion of a bottom of the flapper.

10. The apparatus of claim 1 wherein, as the actuator moves to a first position, the flapper pivots to a closed position.

11. An improved flapper valve system comprising:

a flapper pivotally engaged to a housing and having a closed position at an acute angle to a longitudinal axis of the housing adapted to prevent fluid from a lower bore from entering the upper bore;

an actuator slidingly engaged in the housing, adapted to contact the flapper at a point on the flapper opposite the flapper hinge, and having a first end and a second end, the second end terminating in a contact surface having a first portion and a second portion, the first portion adapted to press against a seat end of the flapper when the flapper is in the closed position in order to break a seal between a valve seat and the seat end so that a pressure differential between the upper bore and the lower bore is reduced; and a bar adapted for engagement to an inner housing wherein the bar has an oblong aperture adapted to receive a hinge pin.

12. The improved flapper valve system of claim 11 further comprising:

a guide key attached to the actuator and protruding perpendicularly into a guide key slot in the housing adapted to orient the actuator;

a through bore in the actuator having an inner diameter the same as an inner diameter of the lower bore and that places the lower bore in communication with the upper bore, allowing fluid to pass between the upper bore and the lower bore when the actuator is in a second position; and an outer diameter of the actuator approximately the same as an inner diameter of the upper bore.

13. The improved flapper valve system of claim 11 further comprising:

a hinge connected to an end of the flapper and pivotally engaged to the housing.

14. An improved flapper valve system comprising:

means for housing a flapper and an actuator;

means for opening the flapper using the actuator; and means for closing the flapper using the actuator so that the actuator makes initial contact with the flapper at a seat end;

means for providing a closed position of the flapper at an acute angle to a longitudinal axis of a housing adapted to prevent fluid from a lower bore from entering an upper bore; and means for providing a first end and a second end of the actuator, the second end terminating in a contact surface adapted to press against the seat end of the flapper when the flapper is in the closed position so that a pressure differential between an upper bore and a lower bore is reduced;

wherein the seat end is an area surrounding a point on a bottom surface of the flapper, that is furthest from a location of pivotal engagement of the flapper and the housing, but that is not in contact with an inner wall of the housing.

15. The improved flapper valve system of claim 14 further comprising:

means for containing the flapper within the housing;

means for connecting the flapper to the housing;

means for moving an actuator; and means for opening the flapper without prior pressure equalization.

16. A method for opening a flapper valve using an actuator without prior pressure equalization comprising:

moving an actuator until the actuator contacts a seat end of the flapper valve to make initial contact with the flapper valve at an area surrounding a point on a bottom surface of the flapper valve, that is furthest from a location of pivotal engagement of the flapper and the housing, but that is not in contact with an inner wall of the housing;

continuing to move the actuator until a seal between the flapper and the housing is broken;

further moving the actuator until the flapper is contained within the housing and a through bore of the actuator allows fluid to pass between an upper bore of the housing and a lower bore of the housing; and using an oblong aperture adapted to receive a hinge pin for securing the flapper to the housing so that the flapper is allowed to move in response to compression of a rubber seal between the flapper and the housing when the flapper is in a closed position.

17. The method of claim 16 further comprising:

passing a drill bit through the through bore of the actuator.

18. The method of claim 16 further comprising:

using a plurality of guide keys attached to the actuator and a plurality of guide key slots in the housing to ensure an interchangeability of a plurality of actuators.

* * * * *